US007059917B1

(12) United States Patent
Tsai

(10) Patent No.: US 7,059,917 B1
(45) Date of Patent: Jun. 13, 2006

(54) DVI ADAPTER

(75) Inventor: Han-Yi Tsai, Taipei Hsien (TW)

(73) Assignee: Sure-Fire Electrical Corp., Taipei Hsien (TW)

( * ) Notice: Subject to any disclaimer, the term of this patent is extended or adjusted under 35 U.S.C. 154(b) by 0 days.

(21) Appl. No.: 11/077,004

(22) Filed: Mar. 11, 2005

(51) Int. Cl.
*H01R 13/502* (2006.01)

(52) U.S. Cl. ..... 439/701

(58) Field of Classification Search ..... 439/700–701, 439/607, 903
See application file for complete search history.

(56) References Cited

U.S. PATENT DOCUMENTS 6,702,623 B1 * 3/2004 Fukuda et al. ..... 439/701
6,743,057 B1 * 6/2004 Davis et al. ..... 439/701
6,764,349 B1 * 7/2004 Provencher et al. ..... 439/701

* cited by examiner

*Primary Examiner*—Phuong Dinh
(74) *Attorney, Agent, or Firm*—Leong C. Lel

(57) ABSTRACT

A DVI adapter includes an inner mold, two matching outer molds, an outer case, a first and a second iron cases; slots, terminal sockets, locking protrusion stubs and frame holes being provided on the inner mold and outer molds; one socket being disposed on the outer side of the outer mold and a ladder being disposed at the upper end of the outer mold; the outer case containing an plate internally inclined and frame holes; both iron cases being each disposed with a plate protruding inwardly; the inner mold and both outer molds being respectively integrated with and combined with terminals and then secured by the outer case and both of the first and the second cases to achieve fast and reliable assembly of the adapter.

1 Claim, 5 Drawing Sheets

DVI ADAPTER

BACKGROUND OF THE INVENTION (a) Technical Field of the Invention

The present invention is related to a DVI adapter, and more particularly, to one that is simple in construction and allows fast and reliable assembly.

(b) Description of the Prior Art

Adapter has been a medium among electronic systems developed to cope with electronic transmission needs for a century. From the electronic computer, electronic transmission is achieved with the adaptation of systems with various functions for business requirements including printers, scanners, and other electronic control systems that are widely applied in medicine, aerospace technology, radar, and aircraft industries while the precision and consistency of electronic transmission are highly demanded.

In such a background, the number of pins on the adapter has been increased from nine up to thirty-one or more. Wherein, each pin is assigned with a contact. The purpose of transmission also varies. Therefore, operation consistency and accuracy in the combination in production are critical to the service life and the normal contact of the terminals of the adapter.

SUMMARY OF THE INVENTION

The primary purpose of the present invention is to provide a DVI allowing fast and reliable assembly. To achieve the purpose the adapter has multiple slots and terminal sockets disposed between the inner mold and both outer molds to accommodate three rows of terminals in different length, and the inner mold is made integrated with those terminals. Multiple protruding stubs and frame holes are alternatively provided on the inner mold and the outer molds to incorporated the inner mold with both outer molds. A cut slot and a ladder are provided on the outer mold for the outer case to fit those plates inclined inwardly and protruding plates disposed on the first and the second cases.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
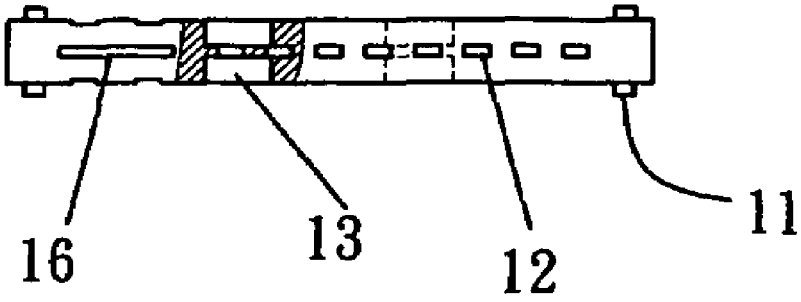
FIGS. 1A and 1B is a schematic view showing an inner mold member of the present invention.
Figure 1B:
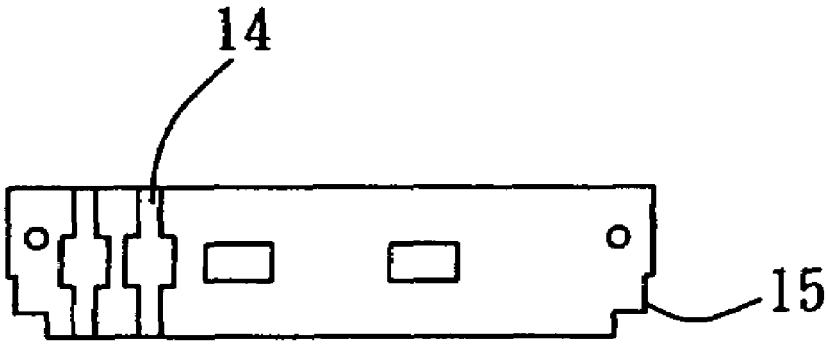

A DVI adapter of the present invention is essentially comprised of an inner mold 10, two outer molds 20, an outer case 30, a first case 41 and a second case 42. As illustrated in FIGS. 1A and 1B for a preferred embodiment of the present invention, the inner mold 10 integrated with multiple terminals has on its both sides respectively provided with a protruding stud 11, and a larger slot 16 and multiple smaller slots 12 in the middle of the inner mold 10. On the front and the rear of the inner mold 10 at where close to the larger slot 16 are each provided with multiple terminal sockets 14, together with those larger and smaller slots 16, 12, to accommodate the molding of terminals in different sizes. Those terminal sockets 14 are made in recess for merely inserting terminals therein. Furthermore, two frame holes 13 are penetrating through the inner mold 10 and a step 15 is provided retracting inwardly to each frame hole 13.

Figure 2A:
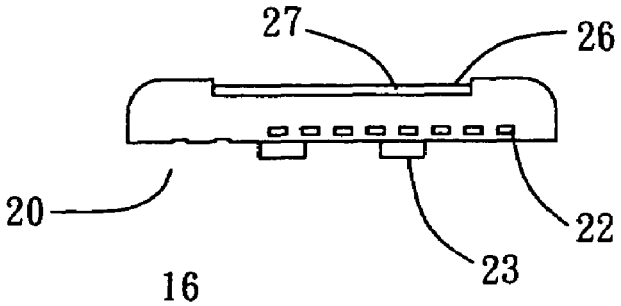
FIGS. 2A, 2B and 2C is a schematic view showing an outer mold member of the present invention.
Figure 2B:
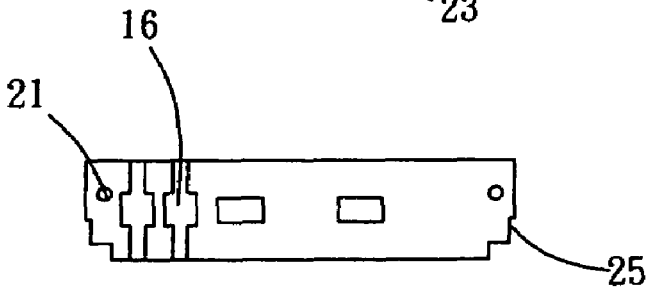
Figure 2C:
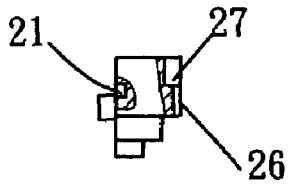

Now referring to FIGS. 2A, 2B and 2C for a schematic view of the outer mold 20. Both outer molds are of the same dimension and each is provided with a hole 21 and a protruding stud 23 at where exactly in alignment with the protruding stud 11 and the frame hole 13 of the inner mold 10 respectively. Multiple smaller slots 22 and terminal slots 24 are disposed at where close to the inner side of each outer mold 20. A cut slot 26 connected with a step is disposed on the outer side of each outer mold 20, and an inner step 25 is provided at the bottom of the outer mold 20.

Figure 3A:
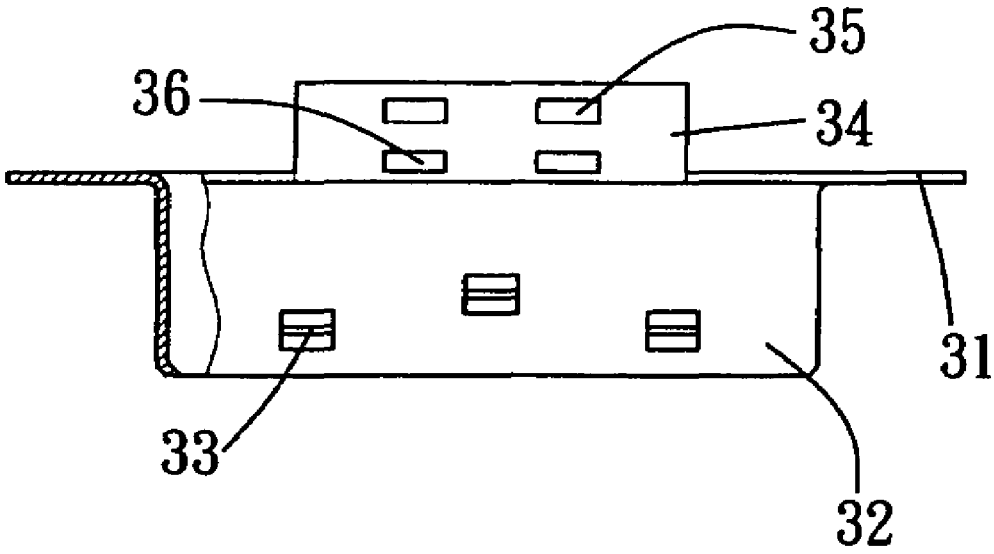
FIGS. 3A and 3B is a schematic view showing an outer case of the present invention.
Figure 3B:
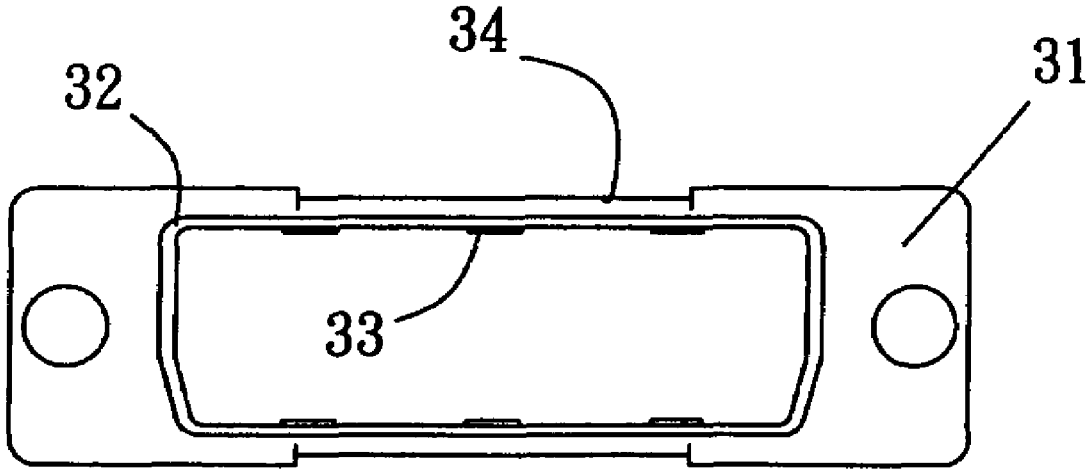

As illustrated in FIGS. 3A and 3B for a schematic view of the outer case 30, the outer case 30 is provided with a hollow frame plate 32 to accommodate the outer mold 20 with the inner step 25 of the outer mold 20 to merely rest on the top edge of the frame plate 32. A recess 33 is provided on both sides of the frame plate 32 and a protruding plate 34 is provided on top of the frame plate 32. Multiple inner inclined plates 35 and frame holes 36 are provided on the protruding plate 34 to press against the step 27 of the outer mold 20. Both sides of the frame plate 32 are respectively provided with a lug 31.

Figure 5:
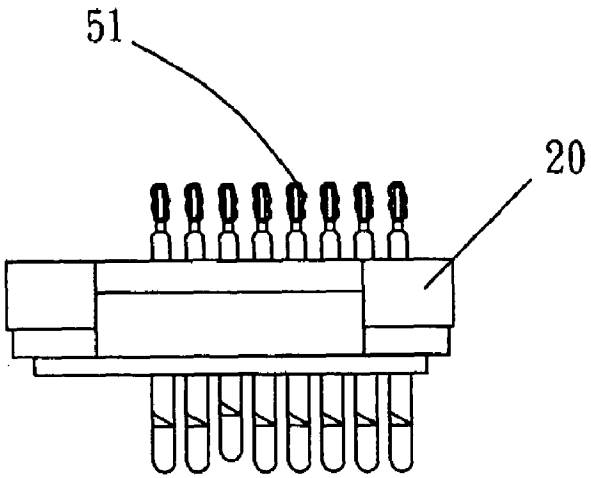
FIG. 5 is a schematic view showing the combination of the outer mold member and multiple terminals.
Figure 4:
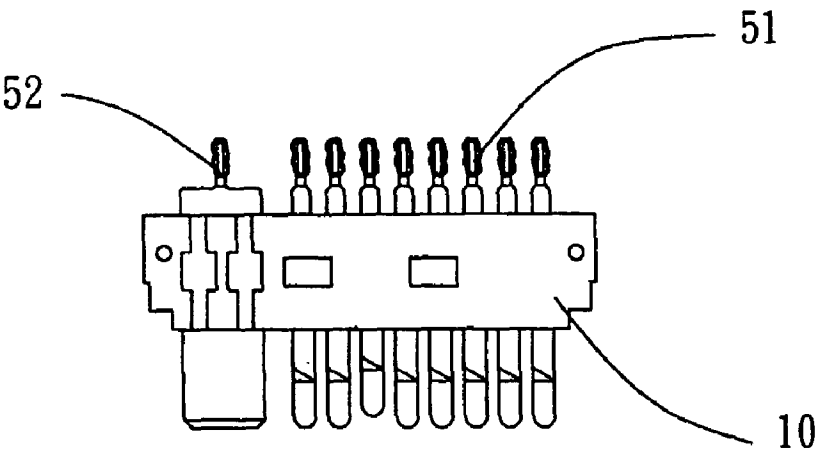
FIG. 4 is a schematic view showing the combination of the inner mold member and multiple terminals.
Figure 6A:
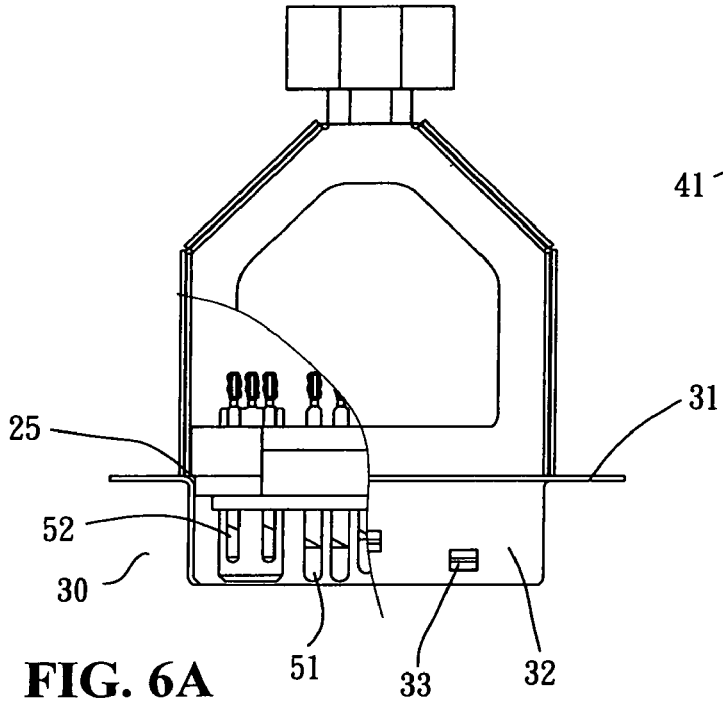
FIGS. 6A, 6B and 6C is a schematic view showing an assembly of the present invention.
Figure 6B:
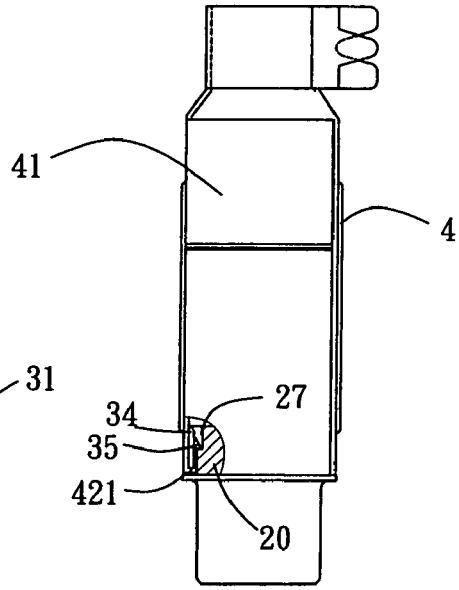
Figure 6C:
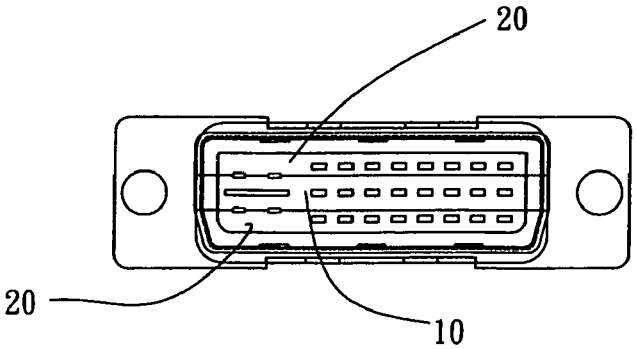

When in assembly (see FIGS. 4 and 5), multiple longer and shorter terminals 51, 52 are designed in a fashion of mortise and tenon so that tin soldering is not required while incorporating with the cable. Each terminal has the same contact volume with the cable to make sure the identical transmission rate. Those longer and shorter terminals 51, 52 are first made integrated with the inner mold 10. The inner mold 10 is then placed between the two outer molds 20 with the frames 13 and the protruding studs 11 engaged with the protruding studs 23 and holes 21. As illustrated in FIGS. 6A, 6B and 6C, the first and the second cases 41, 42 are fit are engaged with the outer case 30 by locking the protruding plates 421 provided at the front end of the first and the second cases 41, 42 into the frame holes 36 of the outer case 30 to be secured in the cut slot 26 of the outer mold 20. Upon completing the assembly, the adapter of the present invention is processed with plastic injection molding outside of the first and the second cases to wrap up the lug 31 to prevent tampering attempts by external force.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A DVI adapter comprising:

an inner mold provided with multiple terminals having on both sides respectively provided with a protruding stud and a larger slot, and multiple smaller slots in a middle of said inner mold, a front and rear of said inner mold being each provided with multiple terminal sockets together with larger and smaller slots to accommodate molding of terminals in different sizes, said terminal sockets being made in recess for inserting terminals therein, two frame holes being penetrating through said inner mold, and a step being provided retracting inwardly to each frame hole;

two outer molds each provided with a hole and a protruding stud in alignment with said protruding stud and said frame hole of said inner mold respectively, multiple smaller slots and terminal slots being disposed close to an inner side of each of said outer molds, a cut slot connected with a step being disposed on an outer side of each of said outer molds, and an inner step being provided at a bottom of each of said outer molds;

an outer case provided with a hollow frame plate to accommodate said outer molds with the inner step of the outer molds to rest on a top edge of said frame plate, a recess being provided on both sides of said frame plate and a protruding plate being provided on a top of said frame plate, multiple inner inclined plates and frame holes being provided on said protruding plate to press against said step of said outer molds, both sides of said frame plate being respectively provided with a lug;

a first case and a second case being made integrated with each other to contain said inner mold, said outer molds and said outer casing, a protruding plate being provided to an end of said first and second cases to be locked into said frame holes of said outer case, said first and second cases being processed with plastic injection molding.

* * * * *